US008833227B2

(12) United States Patent
Pfersmann et al.

(10) Patent No.: US 8,833,227 B2
(45) Date of Patent: Sep. 16, 2014

(54) SEALING RING AND PROPELLANT CHARGE CARTRIDGE

(75) Inventors: Axel Pfersmann, Feucht (DE); Fritz Schlenk, Schnaittach (DE); Manfred Hechtl, Roethenbach (DE); Alfred Eckel, Roethenbach (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 4 days.

(21) Appl. No.: 13/539,669

(22) Filed: Jul. 2, 2012

(65) Prior Publication Data

US 2013/0014634 A1 Jan. 17, 2013

Related U.S. Application Data

(63) Continuation of application No. PCT/EP2011/000227, filed on Jan. 20, 2011.

(30) Foreign Application Priority Data

Feb. 1, 2010 (DE) ..... 10 2010 006 606

(51) Int. Cl.
*F41A 3/74* (2006.01)
*F41A 3/76* (2006.01)
*F42B 5/18* (2006.01)

(52) U.S. Cl.
CPC .... *F41A 3/74* (2013.01); *F41A 3/76* (2013.01)
USPC ..... 89/26; 102/431; 102/469

(58) Field of Classification Search
USPC ..... 89/26; 102/431, 432, 469, 470, 472
See application file for complete search history.

(56) References Cited

U.S. PATENT DOCUMENTS

| | | | | |
|---|---|---|---|---|
| 2,998,755 | A | 9/1961 | Thierry | |
| 3,159,938 | A | 12/1964 | Treat et al. | |
| 3,354,780 | A | 11/1967 | Ramsay | |
| 3,738,223 | A | 6/1973 | Post et al. | |
| 3,738,224 | A * | 6/1973 | Post et al. | 89/26 |

(Continued)

FOREIGN PATENT DOCUMENTS

| | | | |
|---|---|---|---|
| DE | 2 460 391 | A1 | 10/1976 |
| DE | 10 2005 020 669 | A1 | 11/2006 |
| DE | 10 2007 016 204 | A1 | 10/2008 |

OTHER PUBLICATIONS

International Search Report of PCT/EP2011/000227.

*Primary Examiner* — James Bergin
(74) *Attorney, Agent, or Firm* — Laurence A. Greenberg; Werner H. Stemer; Ralph E. Locher

(57) ABSTRACT

A sealing ring obturates a propellant charge cartridge of an automatic firearm for caseless ammunition, in particular against an end face of a firearm element, in particular for a breech or a projectile cartridge. The sealing ring contains a sealing surface that can be brought into contact with the end face. The sealing surface contains a first region around an annular opening of the sealing ring and a second region around the first region. The second region is set back relative to a tangential surface to the first region. In addition, a propellant charge cartridge for an automatic firearm for caseless ammunition, has at least one of the sealing rings. The propellant charge cartridge preferably contains one or multiple, in particular two, propellant charge chambers, which are provided with a sealing ring on each of the breech side and the projectile cartridge side.

12 Claims, 8 Drawing Sheets

(56) References Cited

U.S. PATENT DOCUMENTS

| | | | | | |
|---|---|---|---|---|---|
| 3,783,737 | A * | 1/1974 | Ashley | 89/7 |
| 4,404,888 | A | 9/1983 | Gentiluomo | |
| 5,297,491 | A * | 3/1994 | Sippel et al. | 102/469 |
| 5,535,660 | A * | 7/1996 | Zierler | 89/26 |
| 7,357,059 | B2 * | 4/2008 | Konicke | 89/26 |
| 8,459,166 | B2 * | 6/2013 | Herrmann et al. | 89/26 |
| 2007/0028756 | A1 | 2/2007 | Konicke | |
| 2008/0276796 | A1 * | 11/2008 | Herrmann | 89/26 |
| 2010/0175549 | A1 | 7/2010 | Herrmann et al. | |

* cited by examiner

SEALING RING AND PROPELLANT CHARGE CARTRIDGE

CROSS-REFERENCE TO RELATED APPLICATION

This application is a continuation application, under 35 U.S.C. §120, of copending international application No. PCT/EP2011/000227, filed Jan. 20, 2011, which designated the United States; this application also claims the priority, under 35 U.S.C. §119, of German patent application No. DE 10 2010 006 606.0, filed Feb. 1, 2010; the prior applications are herewith incorporated by reference in their entirety.

BACKGROUND OF THE INVENTION

Field of the Invention

The invention relates to a sealing ring for obturating a propellant charge cartridge of a self-loading rifle for caseless ammunition against one face of a firearm element. Such a sealing ring is known from published, non-prosecuted German patent application DE 10 2005 020 669 A1, corresponding to U.S. patent publication No. 2007/0028756.

The sealing ring of published, non-prosecuted German patent application DE 10 2005 020 669 A1 is a classic so-called C-ring seal (named after the C-shaped cross-section of the sealing ring). Two mutually opposite L-shaped profiles are formed by the ring opening (in cross-sectional view) and their legs that face each other form an annular sealing surface.

A conventional C-ring seal is loosely set in the stepped sealing ring seat provided for it, which means there is a certain amount of clearance in both the axial and radial directions between the sealing ring and the sealing ring seat. At the moment of ignition of the propellant charge body, the C-ring seal can therefore be thrown back towards the weapons breech face (breech), whereby the propellant chamber can be sealed to the rear. With these conventional C-ring seals, however, there was the problem that they responded too slowly with respect to the detonation characteristic of the new propellant charge body. Owing to the inertia of the C-ring seal, the clearance between the propellant charge cartridge base and the thrust base was not closed quickly enough. Therefore very fast particles were blown between the annular sealing surface of the C-ring seal and the end face of the thrust base upon ignition of the propellant charge body. This circumstance led to the sealing of the C-ring seal degrading with time. In order to solve this problem, published, non-prosecuted German patent application DE 10 2005 020 669 A1 proposes to force the sealing ring, which is stepped on the side facing away from the sealing surface, into the lower portion of the cylindrical sealing ring seat under a mechanical preload. With the C-ring seal inserted in this way, the separating gap in the axial direction between the annular sealing surface and the end surface of the breech is closed after the first pressure application. As a result of the mechanical preloading of the sealing ring in its sealing ring seat, the sealing ring adopts a stable contact position to the end face of the breech after this first pressure loading. At the next gas pressure change there is no longer a large axial separation gap between the sealing ring and the breech. A good initial axial seal is thus obtained.

Although the object of published, non-prosecuted German patent application DE 10 2005 020 669 A1 has also led to an improvement in obturation, even with this new obturation method a decreasing sealing effect was observed over time. This manifested itself in a so-called slight blowing out, i.e. leakage of propellant gases between the propellant cartridge and the breech, especially after prolonged firing sequences. The main reason for the decline in the sealing effect was viewed as contamination in the seal area - even occurring with the new obturation method. The contamination of the sealing surface occurring despite the stable contact position of the sealing ring surface to the weapon breech face was explained from the heating of the sealing ring after prolonged fire sequences and an associated bulging of the sealing ring surface towards the outside. The sealing surface contacting the area immediately around the ring opening would thus be reduced. This in turn would lead to an increased blowing out and subsequently to an increasing contamination of the sealing surface. This issue was even considered by experts to be unrecoverable, because a concave indentation of the sealing surface would have to be provided for preventive compensation of the heat-induced bulging of the sealing surface. This would have been counterproductive, however, because an open gap between the seal surface and the weapons thrust base, which would be open to the propellant chamber, would then have arisen in the cold condition of the sealing ring, and the propellant gases, together with the combustion residues contained within them, would penetrate into it. The contamination of the sealing surface that has already occurred in the cold state of the sealing ring would have the effect that sustained obturation is not possible despite the heat-related compensation of the concave indentation in the sealing ring surface.

SUMMARY OF THE INVENTION

It is accordingly an object of the invention to provide a sealing ring and a propellant charge cartridge which overcome the above-mentioned disadvantages of the prior devices of this general type, which improves the obturation of a propellant charge cartridge of a firearm for caseless ammunition against one face of a firearm element.

It was only through precision measurements of new and used sealing rings that the inventors have found that the above situation is surprisingly exactly reversed with the specific geometry of a C-ring seal: as a result of heating by one or more shots from the firearm, the initially plane parallel annular surface of the conventional sealing ring undergoes concave bulging. The propellant gases then blow into the gap formed by heating between the seal surface and the weapon's breech. The combustion residues contained in the propellant gases then accumulate on the sealing ring surface and decrease its sealing effect as a result.

Based on this new knowledge, the inventive concept has been devised that the sealing surface of the sealing ring contains a first region around the annular opening of the sealing ring and a second region around the first region, wherein the second region is set back relative to a plane tangential to the first region. In other words, the second region has a convex shape, i.e. bulging or protruding, relative to the plane-parallel alignment of a classic C-ring seal.

The bulge in the second region is compensated in a short time by the heat resulting from firing, so that the sealing ring can come into plane-parallel contact with the end face of the firearm element over the entire second region without contamination. As was demonstrated through tests with a demonstrator, a sustainable, complete suppression of the blowout can be achieved through the use of the sealing rings according to the invention.

According to a particularly preferred embodiment of the present invention, the first region of the sealing surface has the form of a planar annular surface disposed around the annular opening of the sealing ring, and the second region is in the form of a conically shaped surface adjoining the outside of the annular surface. Here, the flat annular surface is preferably arranged to be placed in plane-parallel contact with the flat end face of the firearms element at ambient temperature. Further, the conically shaped surface is preferably arranged to be placed on the flat end face of the firearms element in a plane-parallel manner after heating of the sealing ring by one or more shots from the firearm.

By the shaping of the first region of the sealing surface as a flat annular surface it is advantageously achieved that a good sealing effect of the sealing ring can also be achieved at the beginning of a firing sequence, as long as the sealing ring is still below its increased operating temperature. If the elevated first region of the sealing surface then reduces downwards or inwards upon heating of the sealing ring, the main sealing surface in the second region of the sealing surface comes to rest against the end face of the firearm element.

The quality of the obturation stands or falls on the magnitude of the angle between the planar annular surface and the conically shaped surface of the sealing ring. This angle is preferably adapted to the deformation behavior of the sealing ring when heated so that the conically shaped surface can be placed on the flat end face of the firearms element in a plane-parallel manner after heating of the sealing ring. In other words, the magnitude of the cone angle of the conically shaped surface in the cold state of the sealing ring is selected such that the cone angle is compensated to 0° by heating of the sealing ring, which means that the second portion of the sealing surface can come into plane-parallel contact with the planar end surface of the firearms element. In order to achieve this, the angle between the planar annular surface and the conically shaped area of the seal surface is in the range of 5 to 20 arc minutes. Particularly preferably, this angle is in the range of 10 to 15 arc minutes, or approximately at 0.2°.

In order to achieve a good sealing effect of the sealing ring, including at the beginning of a firing sequence, the thickness of the annulus of the flat annular surface of the sealing surface, i.e. the difference between the outer annular ring radius and the inner annular ring radius, ranges from 0.5 mm to 2 mm. Particularly preferably, the thickness ranges from 0.5 mm to 1 mm.

For the sealing effect of the sealing ring considered as a whole overall operating temperatures, it has proven to be advantageous that the ratio of the thickness of the annulus of the flat annular surface to the length of the generatrix of the truncated cone of the cone shaped area lies in the range of 1:6 to 1:4. A particularly good overall sealing effect is achieved at a ratio of 1:5.

The material from which the sealing ring is made preferably contains a metal or metal alloy. In particular, the use of high temperature resistant steels is an advantage. It is emphasized that the sealing ring according to the invention needs no flexurally elastic portions and no resiliently biased portions in order to achieve its improved sealing effect. The increased sealing effect is already achieved owing to the heating-related deformation of the sealing surface alone. However, it is of course not excluded that elastic tension of various portions of the sealing ring, such as are described for example in published, non-prosecuted German patent application DE 10 2005 020 669 A1, can also be used to supplement the sealing concept according to the invention.

The sealing ring according to the invention is preferably used in a propellant charge cartridge for an automatic firearm for caseless ammunition. Here, the propellant charge cartridge can contain one or more, preferably two, propellant chambers, which are provided with a sealing ring on each of the breech side and the projectile cartridge side.

According to a particularly preferred embodiment of the present invention, such a propellant charge cartridge contains stepped sealing ring seats, into which the seal rings, which are stepped on the side facing away from the sealing surface, are inserted to form a labyrinth seal. In this case, one or more, preferably six, springs are positioned in the sealing ring seats (preferably in recesses), which press the sealing rings against a stop overlapping the lateral edge of the sealing ring. Thus, advantageously, the clearance between the base of the propellant cartridge and the base of the breech can be variably reduced to zero (be suppressed) by a spring force (depending on the rotational position of the propellant cartridge and depending on the state of thermal expansion of the propellant charge cartridge).

It is also conceivable that the force of this spring can also be actively controlled. Thus the sealing ring could, for example, be actively pressed in a controlled manner against the thrust base just before the ignition of the propellant charge body.

Further advantageous embodiments and improvements of the invention will become apparent from the following description of preferred implementation examples of the invention. It should be noted that the invention also encompasses other embodiments which result from a combination of features that are listed separately in the patent claims and/or in the description and the figures.

Other features which are considered as characteristic for the invention are set forth in the appended claims.

Although the invention is illustrated and described herein as embodied in a sealing ring and a propellant charge cartridge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
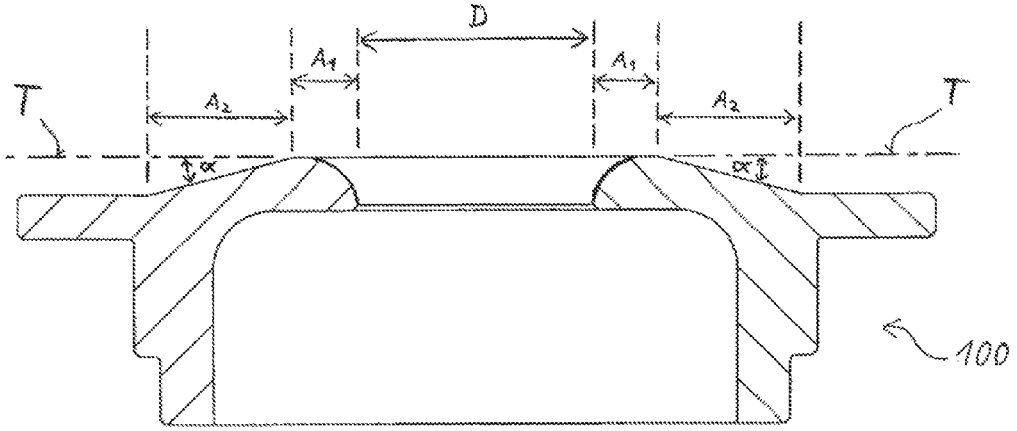
FIG. 1 a diagrammatic, sectional view of a first embodiment of a sealing ring according to the invention.

Referring now to the figures of the drawing in detail and first, particularly, to FIG. 1 thereof, there is shown a sealing ring for obturation, which can especially be used in a firearm for caseless ammunition. Although the use of the sealing ring for a firearm for caseless ammunition is particularly advantageous, this still does not mean that the sealing ring according to the invention could not also be used for a firearm for cased ammunition. The sealing ring 100 of FIG. 1 has an essentially C-shaped cross-section. An annular opening D is radially symmetrically encircled by the essentially L-shaped profile of the sealing ring 100. In the plan view onto FIG. 1 concentric circular structures thus result.

A sealing surface is formed by an upward-facing outer side of a leg of the L-shaped profile in FIG. 1. The sealing surface contains a first region $A_1$ around the annular opening D of the sealing ring 100. The sealing surface also contains a second region $A_2$ around the first region $A_1$. The first region $A_1$ is thus surrounded or enclosed by the second region $A_2$. Here the second region $A_2$ is set back relative to a tangential plane T that is applied to the first region $A_1$. The tangential plane T is not necessarily the end face of a firearm element, i.e. a breech or a projectile cartridge. The tangential plane T is rather any plane tangential to the surface of the first region $A_1$ at any point. Here the first region can—at least partly—lie in a plane that is oriented orthogonally in relation to the central axis of symmetry of the sealing ring 100 through the annular opening D. The first region $A_1$ can, however, only have a surface sloping towards the center of the ring (in FIG. 1: sloping downwards).

This sloping area of the first region $A_1$ can be convexly curved or can slope linearly (funnel-shaped) inwards. However, an equally good mixture of these two above-mentioned options is also possible for the first region $A_1$. Such a mixture is illustrated by way of an example in FIG. 1. There the first region $A_1$ contains a planar annular surface at the center of the ring that merges with a convexly curved sloping surface. The lower inner edge of the annular opening D can be beveled.

The second region $A_2$ encloses the first region $A_1$ and is set back. This means that the points of the area in the second region $A_2$ fall behind (in FIG. 1: below) the highest point of the first region $A_1$. The surface of the second region $A_2$ is thus designed to slope outwards or to fall back.

The structure described above preferably contains the sealing surface of the sealing ring 100 in a state in which it has not been heated by firing rounds. It is therefore possible that the set back orientation of the second region $A_2$ can be gradually compensated by heating during the firing of a number of rounds.

Figure 2:
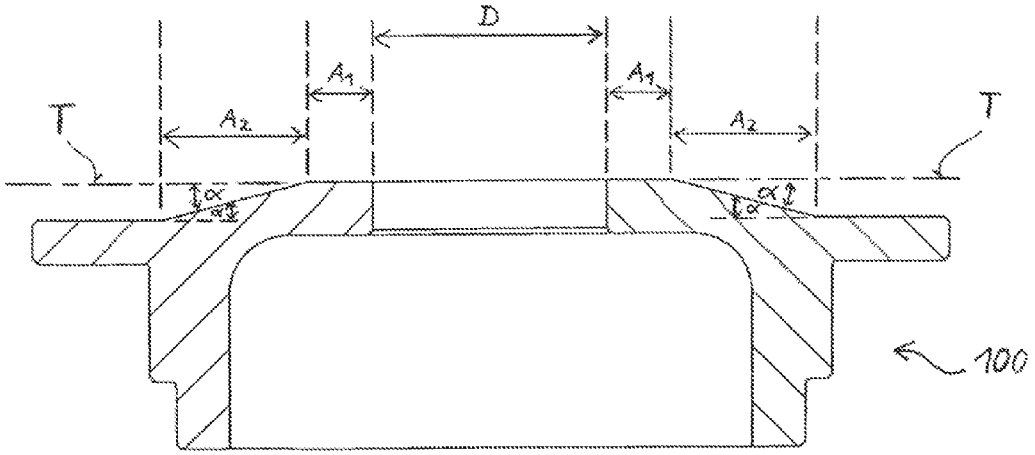
FIG. 2 is a diagrammatic, sectional view of a second embodiment of the sealing ring according to the invention.

FIG. 2 shows a second embodiment of the sealing ring according to the invention. The first region $A_1$ of the sealing surface is in the form of a planar annular surface arranged around the annular opening D of the sealing ring 100. The annular surface lies in a plane orthogonal to the axis of symmetry of the sealing ring 100 through the annular opening D. The upper annular hole edge, which lies in the plane of the planar annular surface, is preferably formed as a sharp edge. This enables a better sealing capability of the sealing ring 100 in the cold state. The lower annular hole edge in turn can also preferably be beveled. The second region $A_2$ of the sealing surface is in the form of a conically shaped surface externally adjoining the annular surface $A_1$.

Because the first region $A_1$ of the sealing surface is in the form of a planar annular surface, this annular surface lies entirely in the tangential plane T described above. The planar annular surface $A_1$ makes the angle $\alpha$ with the conically shaped region $A_2$. The angle $\alpha$, with which the second region $A_2$ slopes relative to the tangential plane T, and thus relative to the planar annular surface $A_1$, is identical in magnitude to the cone angle $\alpha$, i.e. to the angle of slope of the conically shaped region $A_2$.

Figure 3A:
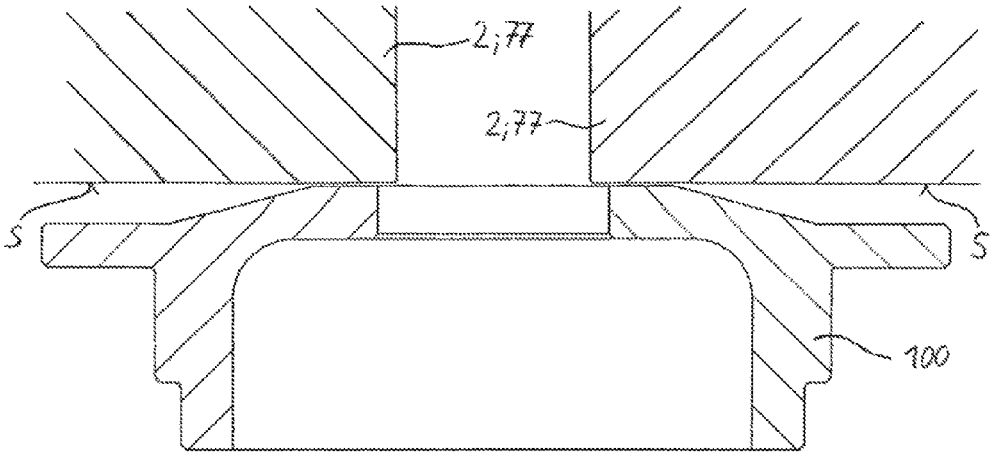
FIG. 3A is a sectional view of an obturation situation using the sealing ring according to the second embodiment in a cold state.

FIG. 3A shows an obturation situation during the use of the sealing ring 100 according to FIG. 2 in the cold state. In the cold state, i.e. at ambient temperature, the planar annular surface $A_1$ is configured to be brought into plane parallel contact with the planar end face S of a breech 77 or a projectile cartridge 2. FIG. 3A shows the sealing ring 100 in this state in this position, in which the planar annular surface $A_1$ contacts the planar end face S in a plane parallel manner. In this situation, as a result of forming the first region $A_1$ of the sealing surface as a planar annular surface, as well as through the sharp edged nature of the rectangular shape of the upper inner edge of the annular opening D, a good sealing effect of the sealing ring 100 can be achieved in an advantageous manner, even at the beginning of a firing sequence, provided that the sealing ring 100 is below its increased operating temperature. The sealing function in this phase is thus mainly undertaken by the first region $A_1$ about the annular opening D of the sealing ring 100.

Figure 3B:
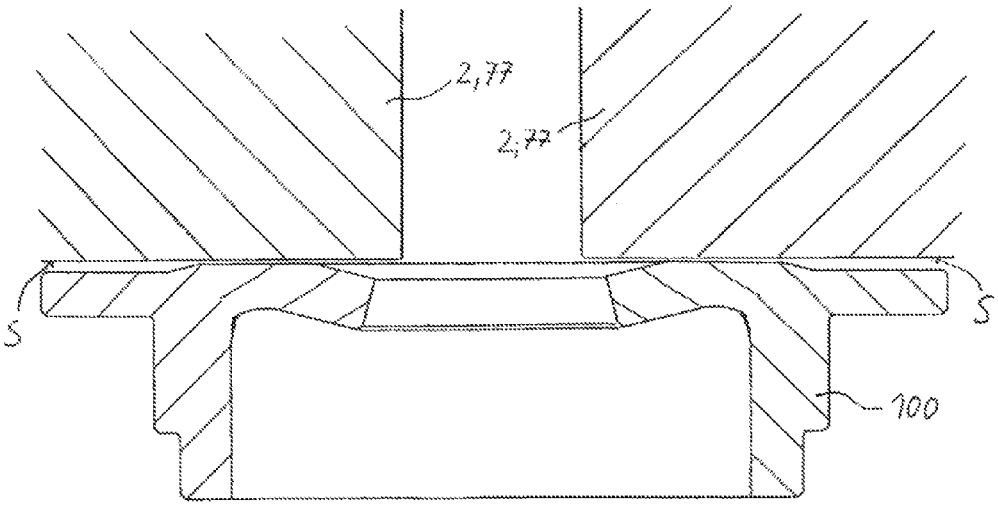
FIG. 3B is a sectional view of an obturation situation using the sealing ring according to the second embodiment in a heated state.

FIG. 3B shows an obturation situation during the use of the sealing ring 100 according to FIG. 2 in the heated state. Through the firing of multiple rounds, the sealing ring 100 has been heated to the extent that the originally raised first region $A_1$ of the sealing surface has become lowered, as a result of which the original conically rising second region $A_2$ of the sealing surface comes into plane parallel contact with the planar end face S of the breech 77 or the projectile cartridge 2. In this state the second region $A_2$ of the sealing surface now mainly undertakes the obturation function.

The magnitudes of the angle $\alpha$ between the planar annular surface $A_1$ and the conically shaped region $A_2$ and/or the cone angle $\alpha$ are shown greatly exaggerated for clarity in FIGS. 1 to 3B. In reality, the corresponding angle $\alpha$ is so small that it can hardly be detected with the naked eye. The magnitude of the angle $\alpha$ for the sealing ring 100 for a firearm in the caliber range of 10 to 20 mm lies in the range from 5 to 20 arc minutes, preferably in the range from 10 to 15 arc minutes.

Figure 4:
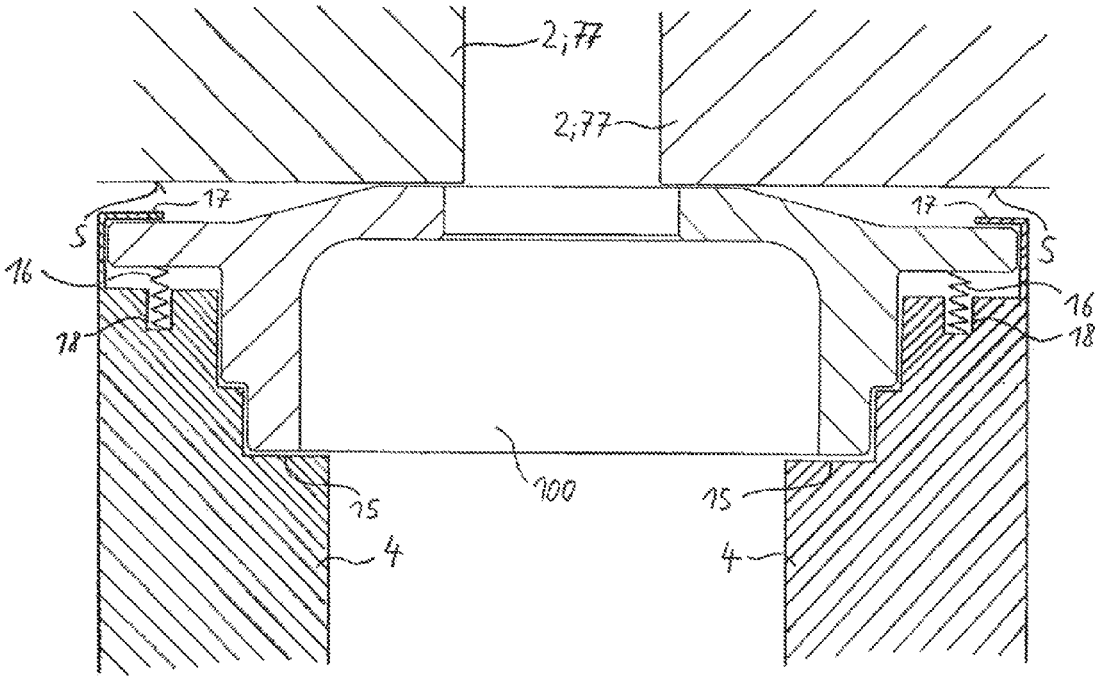
FIG. 4 is a sectional view of the obturation situation using the sealing ring according to the second embodiment in the context of using a sealing ring seat of a propellant charge cartridge.

FIG. 4 shows an obturation situation with the sealing ring 100 according to FIG. 2 in the context of using a sealing ring seat 15 of a propellant charge cartridge 4. The sealing ring seat 15 is of stepped form. The steps of the sealing ring seat 15 form the counter piece to the stepped shape of the sealing ring 100 on its side facing away from the sealing surface. With this configuration a labyrinth seal, which seals the sealing ring 100 laterally and radially, is formed with the formation of multiple, alternating, successive annular gaps and cylindrical casing-shaped gaps. In order to enhance the lateral sealing effect of the sealing ring 100, one can resort to the concept of published, non-prosecuted German patent application DE 10 2005 020 669 A1. Recesses 18 for accommodating springs 16 are provided in the sealing ring seat 15. The springs 16 press the sealing ring 100 against a stop 17, which overlaps the lateral edge of the sealing ring 100. In this way the clearance between the base of the propellant charge cartridge and the base S of the breech can be variably reduced to zero, i.e. closed up, in an advantageous manner by spring force (depending on the angular position of the propellant charge cartridge 4 and the state of thermal expansion of the propellant charge cartridge 4).

Figure 5:
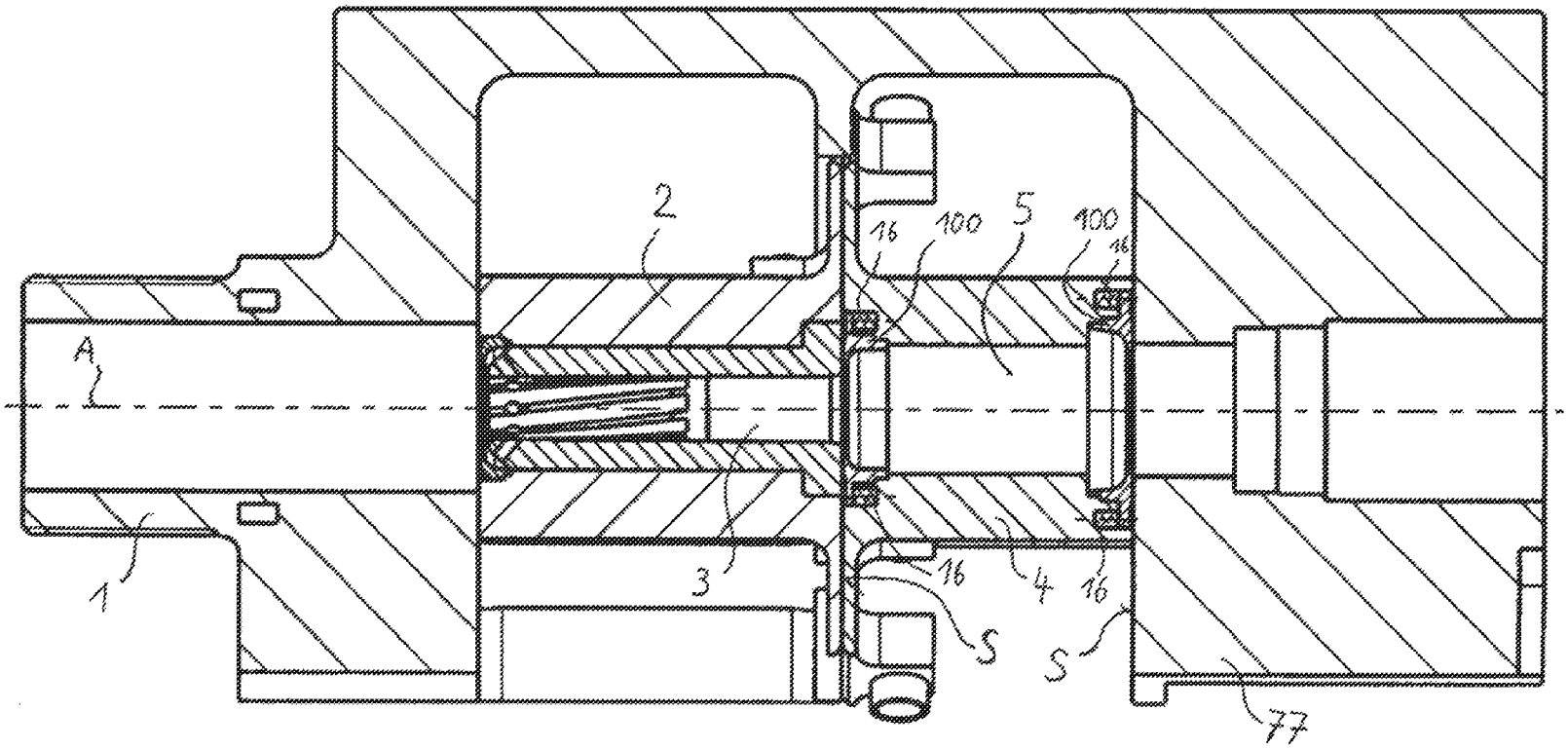
FIG. 5 is a sectional view, which illustrates the use of the sealing rings according to the invention or the propellant charge cartridge according to the invention in a firearm for caseless ammunition, which is essentially in the operating state of FIG. 7G.
Figure 7A:
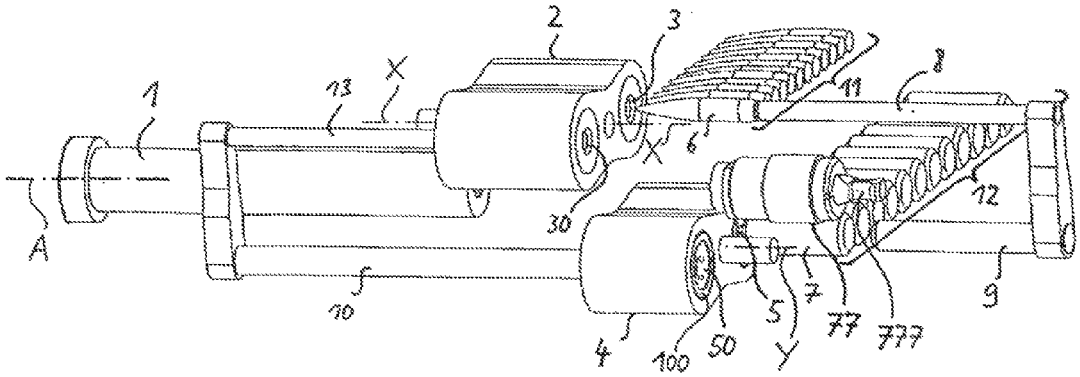
FIGS. 7A to 7G are perspective views showing several successive snapshots of an automatic firearm for caseless ammunition, in which the sealing ring according to the invention and the propellant charge cartridge according to the invention can be brought into use in an advantageous manner.
Figure 7B:
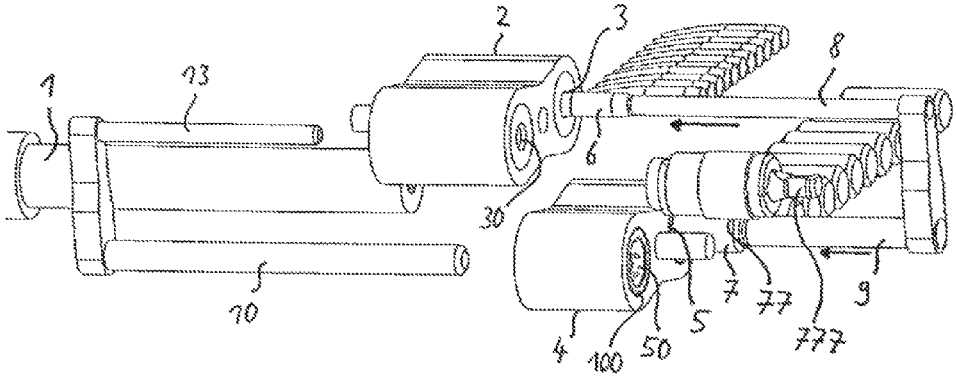
Figure 7C:
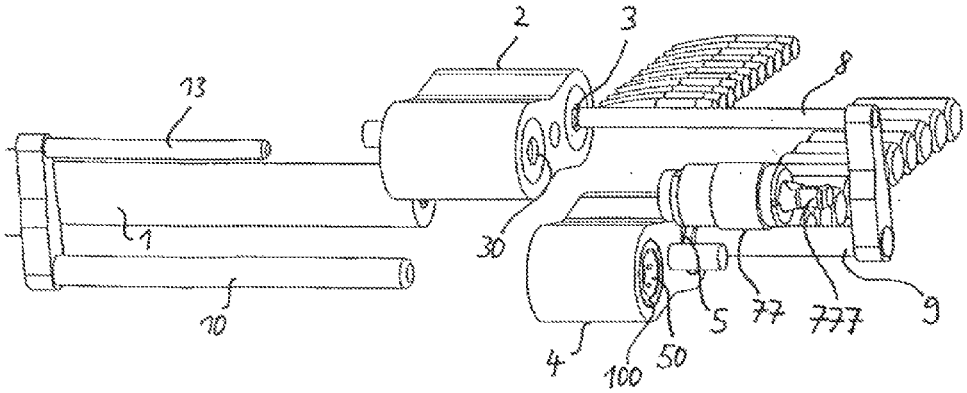
Figure 7D:
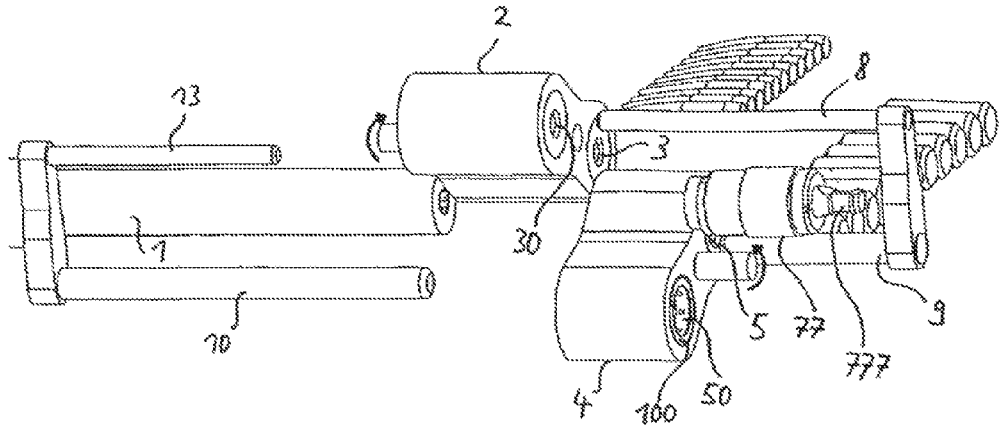
Figure 7E:
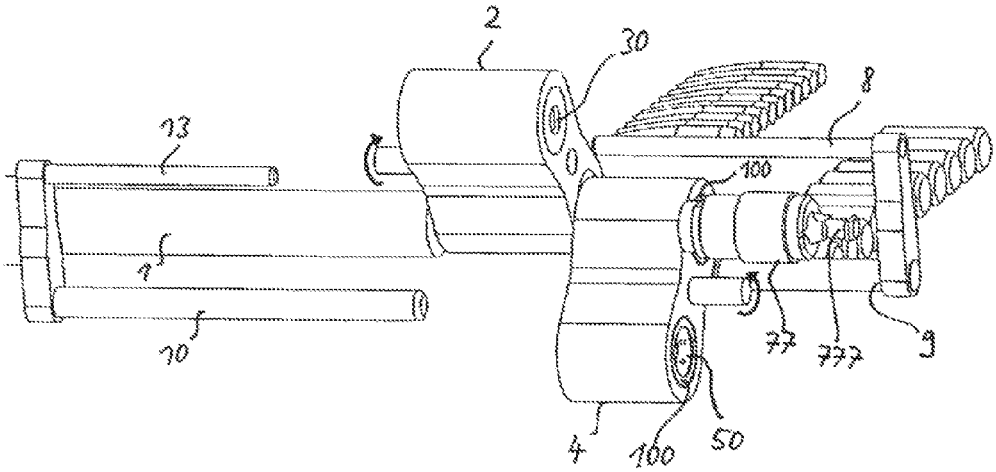
Figure 7F:
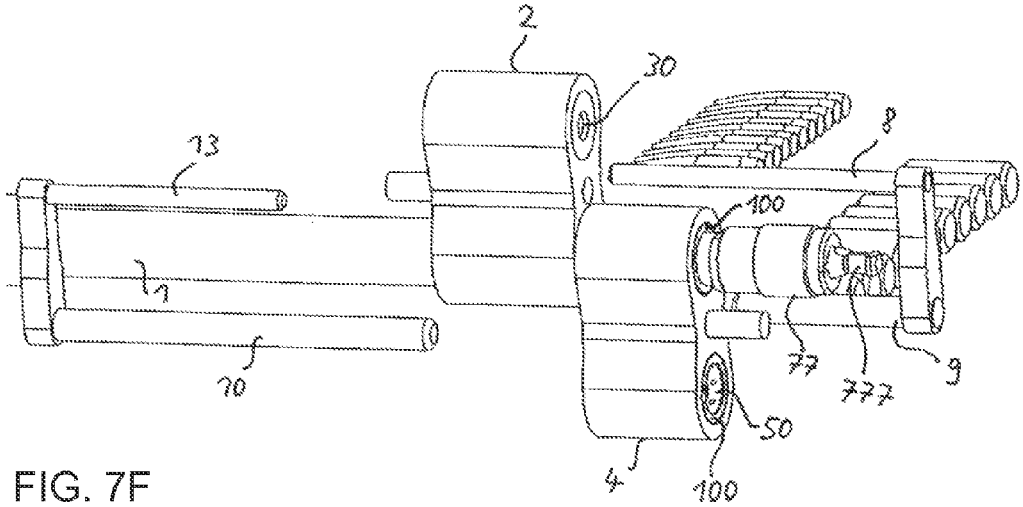
Figure 7G:
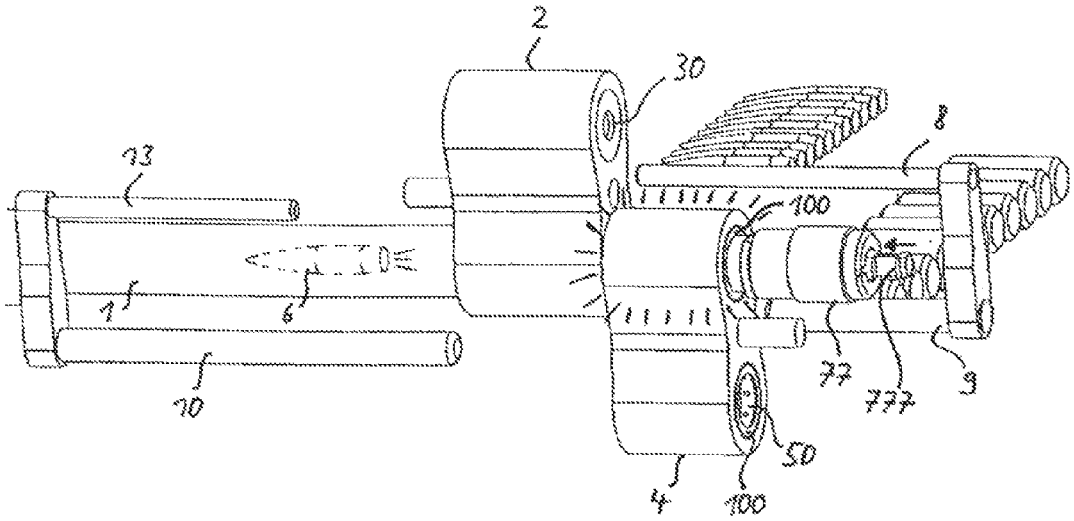

FIG. 5 shows a sectional drawing, which illustrates the use of the sealing ring 100 according to the invention or the propellant charge cartridge 4 according to the invention in a firearm for caseless ammunition, which is essentially in the operating state of FIG. 7G. In this operating state the breech 77, a propellant charge chamber 5 of the propellant charge cartridge 4, a projectile chamber 3 of the projectile cartridge 2 and the barrel 1 of the firearm are accurately aligned relative to each other. This means that the longitudinal axis of the projectile chamber 3 and the longitudinal axis of the propellant charge chamber 5 lie on the projection of the bore axis A of the barrel 1 of the firearm. In this position the projectile 6 will be fired.

Figure 6A:
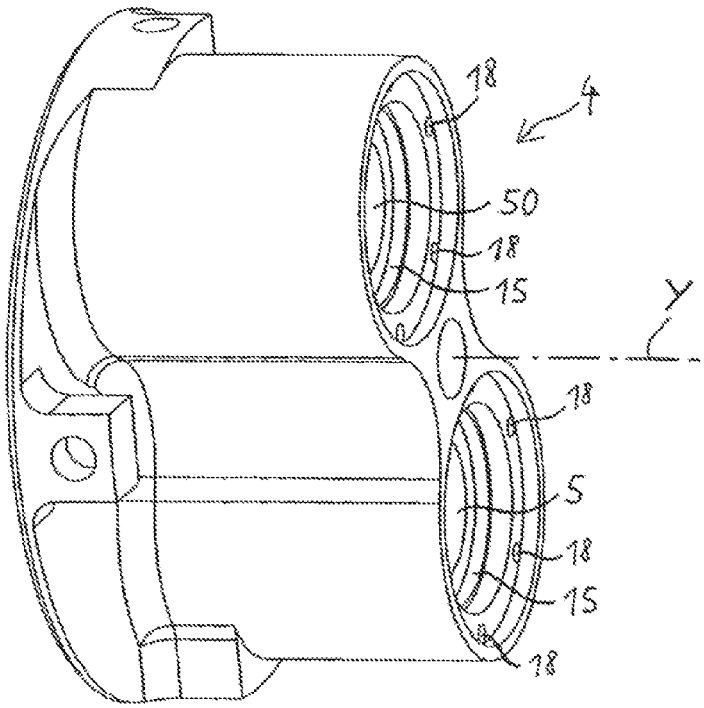
FIGS. 6A and 6B are perspective views of an embodiment of the propellant charge cartridge according to the invention without sealing rings.
Figure 6B:
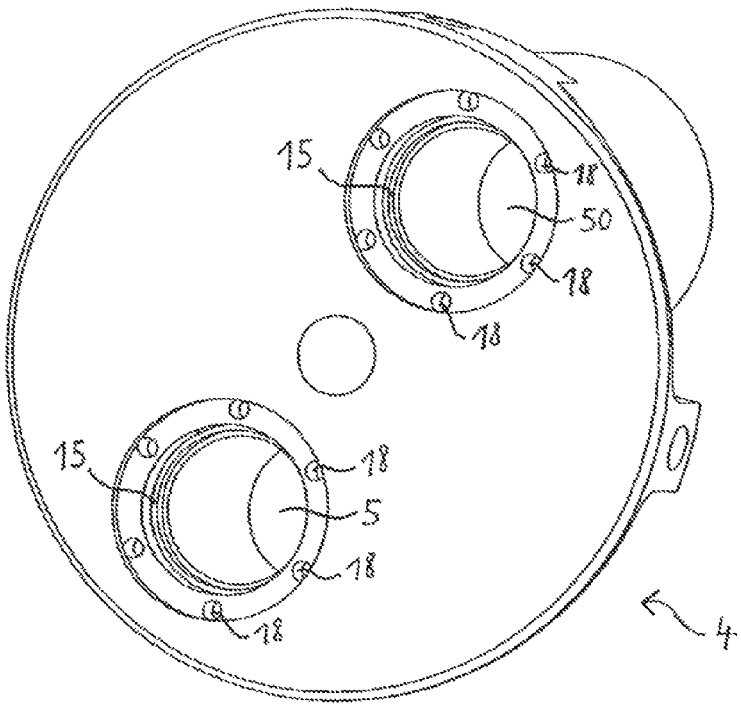

As shown in FIG. 5, the propellant charge cartridge 4 according to the invention is arranged between the end face S of the breech 77 and the end face S of the projectile cartridge 2. FIGS. 6A and 6B show perspective illustrations of an embodiment of the propellant charge cartridge 4 according to the invention (for clearer illustration, without the yet-to-be-inserted sealing rings 100). The stepped sealing ring seats 15 with the recesses 18 for the springs 16 can be clearly seen in FIGS. 6A and 6B. According to the preferred embodiment of the propellant charge cartridge 4 according to the invention, the propellant charge cartridge 4 contains two propellant charge chambers 5, 50. A sealing ring 100 is inserted at the leading end and at the trailing end of each propellant charge chamber 5, 50 in each case according to the illustration in FIG. 4. The entire propellant charge cartridge 4 with its two propellant charge chambers 5, 50 thus contains four sealing rings 100.

Finally, for explanatory purposes FIGS. 7A to 7G show several successive snapshots of an automatic firearm for caseless ammunition, in which the sealing ring 100 according to the invention and the propellant charge cartridge 4 according to the invention can be put to use in an advantageous manner.

Reference number 1 designates a barrel of a firearm of a preferably automatically operated weapon system with caseless ammunition and high firing rate. The weapon system contains a projectile cartridge 2, preferably with two chambers 3, 30 for accommodating projectiles 6 disposed in a storage chamber or loading chamber 11. An insertion device 8 is used to bring the projectile 6 positioned in the insertion position into the chamber 3 of the projectile cartridge 2 (see FIGS. 7A to 7C). In the loading chamber 11 there is a plurality of stored projectiles 6, which can be delivered into the insertion position for the next chamber, e.g. 30, with a (not illustrated) delivery device.

In addition, the weapon system contains a propellant charge cartridge 4 with a plurality of chambers 5, 50, into each of which a propellant charge 7 can be introduced. Preferably, the number of chambers 5, 50 of the propellant charge cartridge 4 is the same as the number of chambers 3, 30 of the projectile cartridge 2. In the present example of FIGS. 5, 6 and 7 the number of chambers 5, 50 of the propellant charge cartridge 4 is thus two. Loading of the propellant charge cartridge 4 is ensured with an insertion device 9. The stored propellant charges 7 located in the loading chamber 12 are successively brought into the insertion position and delivered to the respective chamber (in FIGS. 7A to 7C: chamber 5) of the propellant charge cartridge 4. Both the propellant charge cartridge 4 and also the projectile cartridge 2 are implemented as rotary cartridges, which preferably rotate in opposite directions. As a result of the contrarotation of the propellant charge cartridge 4 and the projectile cartridge 2, very smooth running of the weapon system can be achieved. The reason for the enhanced running smoothness is the mutual compensation of any imbalances of the propellant charge cartridge 4 and the projectile cartridge 2 as well as the mutual compensation of bearing forces, which act on the rotary bearings of the propellant charge cartridge 4 and the projectile cartridge 2. As can be seen in FIG. 7A, the propellant charge cartridge 4 is mounted to rotate about the axis of rotation Y and the projectile cartridge 2 is mounted to rotate about the axis of rotation X. The two axes X, Y are each disposed offset parallel to the bore axis A of the weapon barrel 1. The propellant charge cartridge 4 and the projectile cartridge 2 are disposed between the rear end of the barrel 1 of the weapon and the breech 77. The breech 77 comprises a firing pin 777.

A first phase of the operating cycle of the weapon system is illustrated in FIGS. 7A to 7C, in which the chamber 3 of the projectile cartridge 2 is in a first position, namely a loading position. The insertion device 8 for inserting a projectile 6 in this chamber 3 can be activated in this first position. Further, in this first position the chamber 5 of the propellant charge cartridge 4 is in the loading position, in which an insertion device 9 for inserting a propellant charge 7 into this chamber 5 can be activated. FIGS. 7A to 7C show these two insertion processes for the projectile 6 and the propellant charge 7. Here the insertion device 8 for insertion of the projectile 6 in the chamber 3 and the insertion device 9 for inserting the propellant charge 7 in the chamber 5 can be coupled to each other. Through this—preferably rigid—coupling 15 between the two insertion devices 8, 9, synchronous insertion of the projectile 6 and the propellant charge 7 can be achieved in a simple manner.

FIGS. 7D and 7E show the transition from the first position into a second position, the firing position, as is illustrated in FIGS. 7F, 7G and FIG. 5. In the firing position, chamber 3 of the projectile cartridge 2 and chamber 5 of the propellant charge cartridge 4 are aligned with the barrel 1 of the weapon. The transition between the first position and the second position is achieved by the preferable contrarotation of the projectile cartridge 2 and the propellant charge cartridge 4 about their respective axes of rotation X, Y.

In the firing position (see FIG. 7G and FIG. 5), the end faces S of the projectile cartridge 2 and the breech 77 seal tightly with the propellant charge chamber 5 of the propellant charge cartridge 4, thanks to the two sealing rings 100. This ensures optimal pressure development during ignition of the propellant charge 7.

During the rotation phase of the projectile cartridge 2 and the propellant charge cartridge 4 illustrated in FIGS. 7D and 7E, the insertion devices 8, 9 are preferably not moved or if necessary are withdrawn to a small extent from the maximum insertion position of FIG. 7C, in order to ensure undisturbed rotation of the projectile cartridge 2 and the propellant charge cartridge 4.

In FIG. 7G and FIG. 5 the firing pin 777 is operated in the firing position. The firing pin 777 strikes the propellant charge body 7 located in chamber 5, and possibly a percussion cap attached to the propellant charge 7. The propellant charge 7 then explodes in the chamber 5 of the propellant charge cartridge 4 and accelerates the projectile 6 located in the chamber 3, which is accelerated through the barrel 1 of the weapon towards the target.

Further cycle steps and operating situations of an automatic firearm described above for caseless ammunition can be found in international patent disclosure WO 2009/146809 A1, corresponding to U.S. patent publication No. 2011/0083548. With the aid of the sealing ring 100 according to the invention, a sustainable, complete sealing of a propellant charge cartridge of a weapon for caseless ammunition can be achieved over the entire operating temperature range.

The invention claimed is:

1. A sealing ring for obturation of a propellant charge cartridge of an automatic firearm for caseless ammunition, relative to an end face of a firearm element, including a breech or a projectile cartridge, the sealing ring comprising:

a sealing surface for being brought into contact with the end face, said sealing surface having a first region defining an annular opening of the sealing ring, said first region of said sealing surface being a planar annular surface around said annular opening of the sealing ring and a second region disposed around said first region, said second region being set back relative to a tangential plane that is tangential to said first region, said second region being a conically shaped surface externally adjoining said planar annular surface, an angle between said planar annular surface and said conically shaped surface being in a range from 5 to 20 arc minutes, said conically shaped surface being disposed for being brought into plane parallel contact with the end face following heating of the sealing ring by at least one firing from the automatic firearm.

2. The sealing ring according to claim 1, wherein said planar annular surface is disposed to be brought into plane parallel contact with the end face at ambient temperature.

3. The sealing ring according to claim 1, wherein a thickness of an annulus of said planar annular surface being a difference between an outer annulus radius and an inner annulus radius, is in a range from 0.5 mm to 2 mm.

4. The sealing ring according to claim 3, wherein a ratio of said thickness of said annulus of said planar annular surface to a length of generatrix of a conical frustum of said conically shaped surface is in a range from 1:6 to 1:4.

5. The sealing ring according to claim 3, wherein a ratio of said thickness of said annulus of said planar annular surface to a length of generatrix of a conical frustum of said conically shaped surface is 1 to 5.

6. The sealing ring according to claim 1, wherein a material from which the sealing ring is manufactured is selected from the group consisting of a metal and a metal alloy.

7. The sealing ring according to claim 1, wherein an angle between said planar annular surface and said conically shaped surface is in a range from 10 to 15 arc minutes.

8. The sealing ring according to claim 1, wherein a thickness of an annulus of said planar annular surface being a difference between an outer annulus radius and an inner annulus radius, is in a range from 0.5 mm to 1 mm.

9. The sealing ring according to claim 1, wherein a material from which the sealing ring is manufactured contains steel.

10. A propellant charge cartridge for an automatic firearm for caseless ammunition, comprising:

a cartridge body having a breech side and a projectile cartridge side each with an end face;

sealing rings according to claim 1; and said cartridge body having two propellant charge chambers each being provided with one of said sealing rings on said breech side and on said projectile cartridge side.

11. The propellant charge cartridge according to claim 10, wherein said cartridge body having a stop;

wherein said cartridge body having stepped sealing ring seats, into which said sealing rings, which are stepped on a side remote from said sealing surface, are inserted to form a labyrinth seal; and further comprising at least one spring disposed in said sealing ring seats, said spring pressing said sealing rings against said stop overlapping a lateral edge of said sealing rings.

12. The propellant charge cartridge according to claim 11, wherein:

said sealing ring seats have recesses formed therein; and said spring is one of six springs disposed in said recesses of said sealing ring seats.

* * * * *